US007766165B2

(12) United States Patent
Kirtlink

(10) Patent No.: US 7,766,165 B2
(45) Date of Patent: Aug. 3, 2010

(54) TOOL CADDY HAVING CARRIER PROXIMATE CENTER OF GRAVITY

(76) Inventor: Robert E. Kirtlink, 1938 Waverly St., Napa, CA (US) 94558

( * ) Notice: Subject to any disclaimer, the term of this patent is extended or adjusted under 35 U.S.C. 154(b) by 691 days.

(21) Appl. No.: 11/651,698

(22) Filed: Jan. 10, 2007

(65) Prior Publication Data

US 2008/0164170 A1 Jul. 10, 2008

(51) Int. Cl.
*B65D 85/28* (2006.01)

(52) U.S. Cl. ..... 206/373; 280/47.35; 220/669; 206/349

(58) Field of Classification Search ..... 206/373, 206/374, 375, 822; 224/576, 575; 280/47.26, 280/47.35, 79.3, 79.6; 220/17.1, 669, DIG. 13; 211/70.6; 294/143, 146
See application file for complete search history.

(56) References Cited

U.S. PATENT DOCUMENTS

| | | | | |
|---|---|---|---|---|
| 1,660,521 | A * | 2/1928 | Nordgren | 211/70.6 |
| 2,596,749 | A * | 5/1952 | Webber | 211/70.6 |
| 3,128,022 | A * | 4/1964 | Mastrud, Jr. | 294/146 |
| 5,715,968 | A * | 2/1998 | Fink et al. | 220/669 |
| 6,910,577 | B2 * | 6/2005 | O'Sullivan | 206/373 |
| 7,434,820 | B1 * | 10/2008 | Aliseo | 280/47.35 |

* cited by examiner

*Primary Examiner*—J. Gregory Pickett
*Assistant Examiner*—Andrew Perreault
(74) *Attorney, Agent, or Firm*—Craig R. Miles; CR Miles, P.C.

(57) ABSTRACT

A tool caddy which provides a carrier having open sides and a recess element configured to receive a part of the body of person in an open recess area to locate such part of the body closer to the center of mass of the tool caddy.

8 Claims, 6 Drawing Sheets

TOOL CADDY HAVING CARRIER PROXIMATE CENTER OF GRAVITY

I. BACKGROUND

A tool caddy which provides a carrier having open sides and a recess element configured to receive a part of the body of person in an open recess area to locate such part of the body closer to the center of mass of the tool caddy.

Conventional tool boxes typically provide sidewalls and bottom which establish an enclosed space in which tools can be removably placed. This conventional construction form has disadvantages. A first disadvantage can be that tools contained inside the enclosed space cannot be accessed from the sides of the tool box. A person must reach inside the enclosed space from the open top portion of the tool box to access and return tools. Depending on the task and the position of the person relative to the conventional tool box this may be an impediment to performing task(s). Additionally, tools placed inside a conventional tool box may lay on top of one another contributing to the difficulty of removing and returning tools.

A second disadvantage of conventional tool boxes can be a construction form which locates the center of mass of the tool box a distance away from the body of a person carrying the tool box. The greater the distance the center of the tool box is located from the body of the person carrying it the more difficult carrying the conventional tool box can become.

II. SUMMARY OF THE INVENTION

Accordingly, a broad object of the invention can be to provide a tool caddy which as to certain embodiments of the invention can provide a configuration which locates the center of mass closer to the body of the person when carried or allows a part of the body of the person carrying the tool caddy to be located closer to the center of mass of the inventive tool caddy.

A second broad object of the invention can be to provide a tool caddy which as to certain embodiments of the invention provides an open sided configuration which allows tools to be accessed and secured without having to reach inside an enclosed space or container established by the walls of a conventional tool box.

A third broad object of the invention can be to provide a tool caddy having an open sided configuration and which further provides a configuration which locates the center of mass of the tool caddy closer to the body of the person when carried or allows a part of the body of the person carrying the tool caddy to be located closer to the center of mass of the inventive tool caddy.

Naturally, further objects of the invention are disclosed throughout other areas of the specification, drawings, photographs, and claims.

III. A BRIEF DESCRIPTION OF THE DRAWINGS

Figure 1:
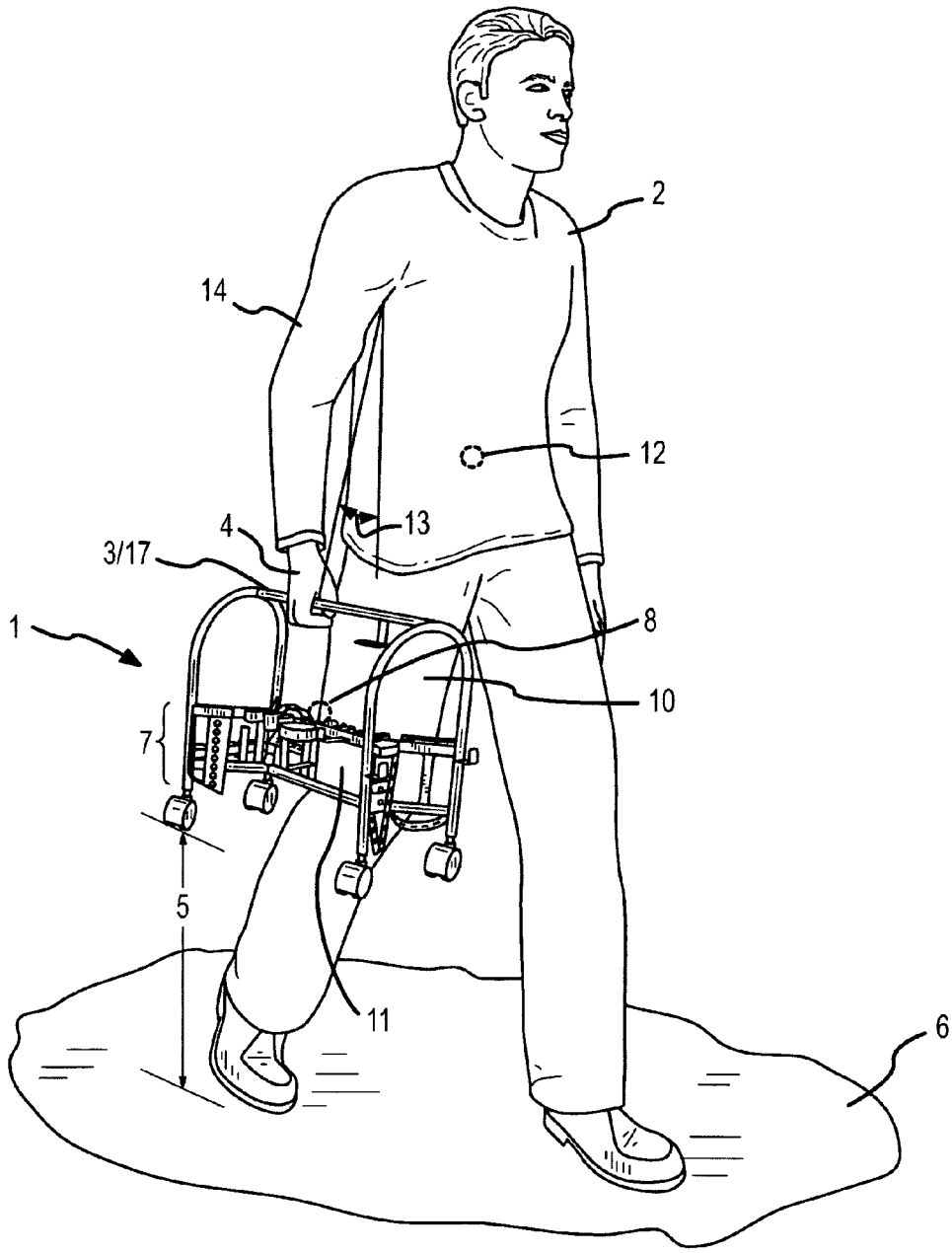

FIG. 1 provides a perspective drawing showing a particular method of using a particular embodiment of the invention.

Figure 2:
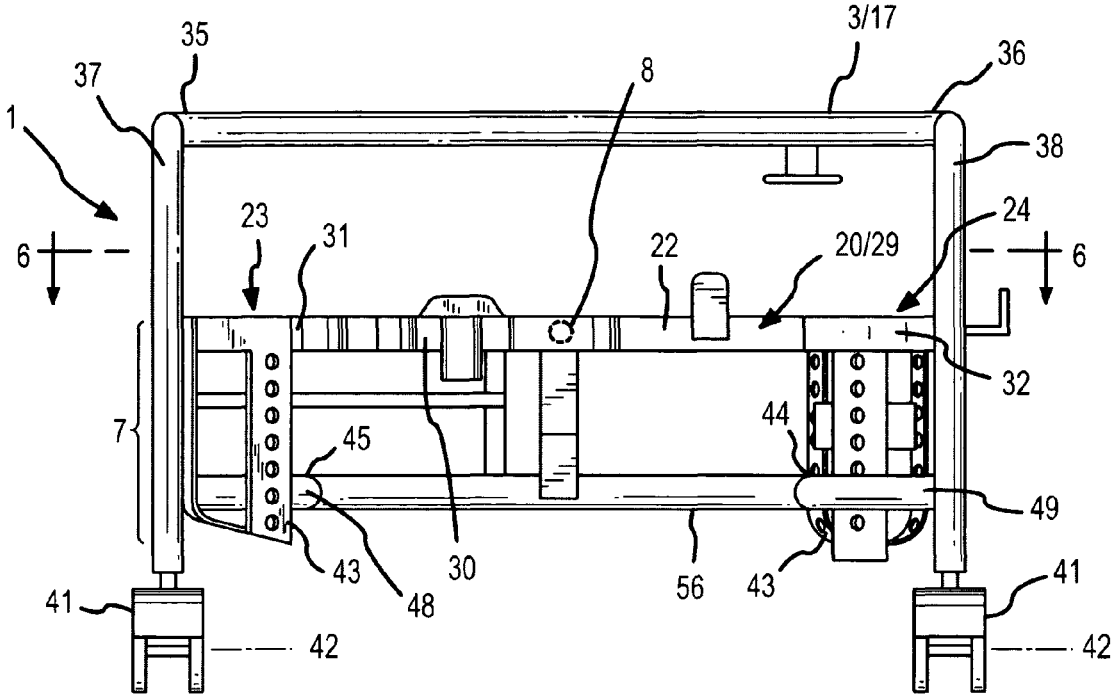

FIG. 2 provides a first side view of a particular embodiment of the invention having open sides.

Figure 3:
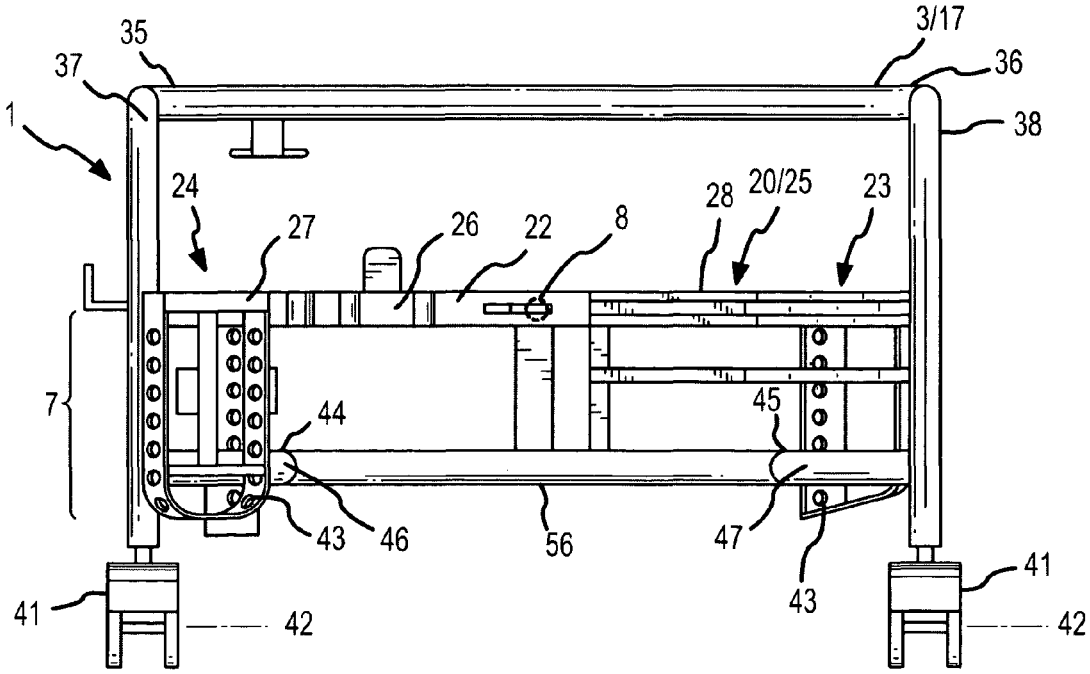

FIG. 3 provides an alternate side view of a particular embodiment of the invention having open sides.

Figure 4:
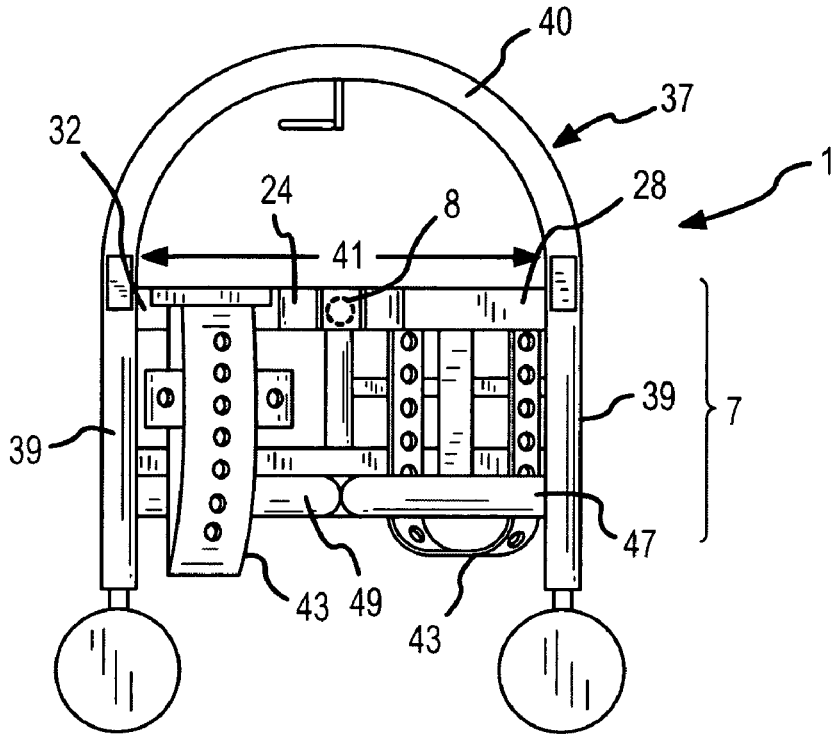

FIG. 4 provides a first end view of a particular embodiment of the invention having open sides.

Figure 5:
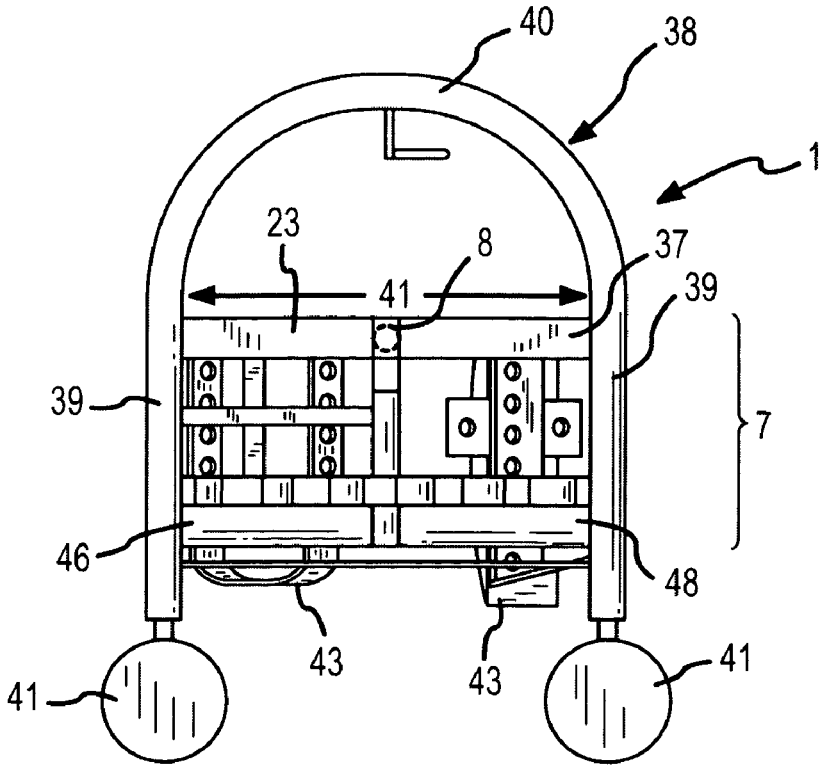

FIG. 5 provides an alternate side view of a particular embodiment of the invention having open sides.

Figure 6:
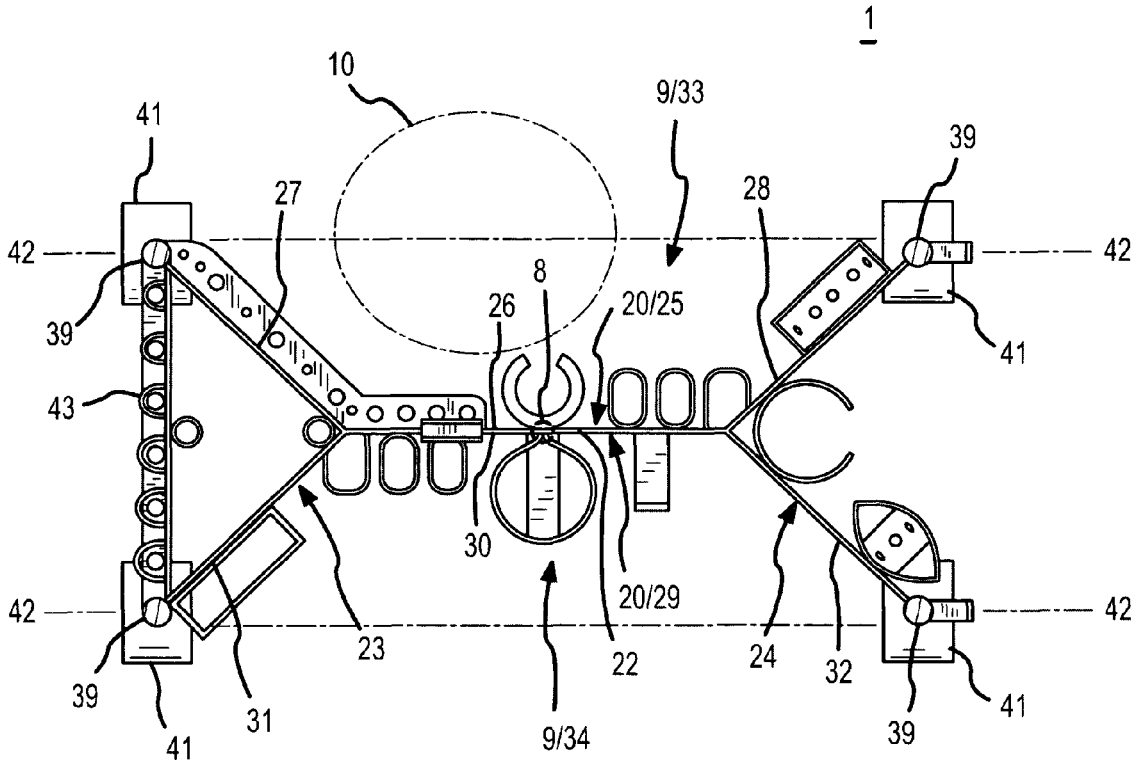

FIG. 6 provides a cross section view 6-6 of the embodiment of the invention shown in FIG. 2.

Figure 7:
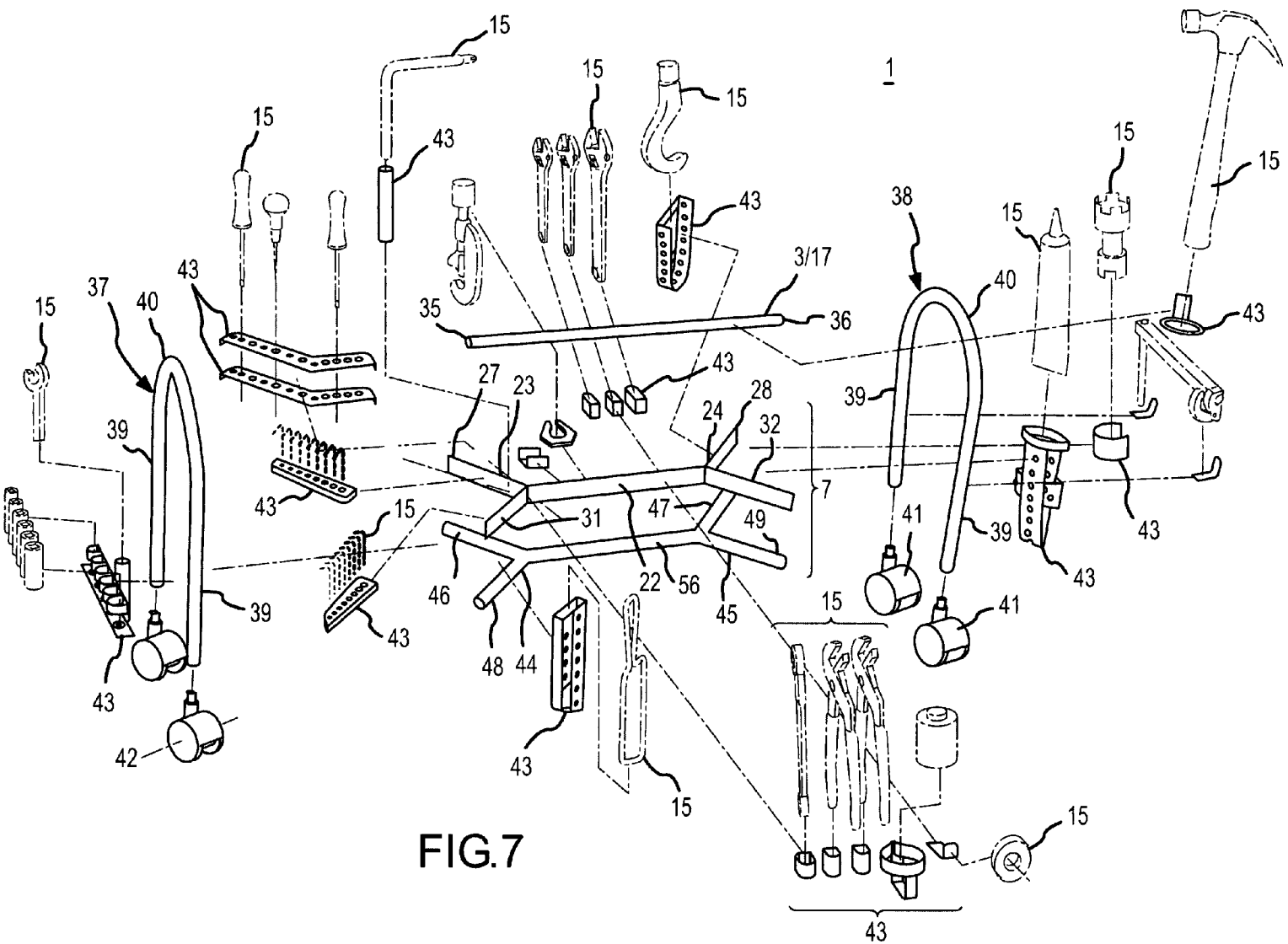

FIG. 7 provides an exploded view of the embodiment of the invention shown in FIGS. 1-6.

Figure 8:
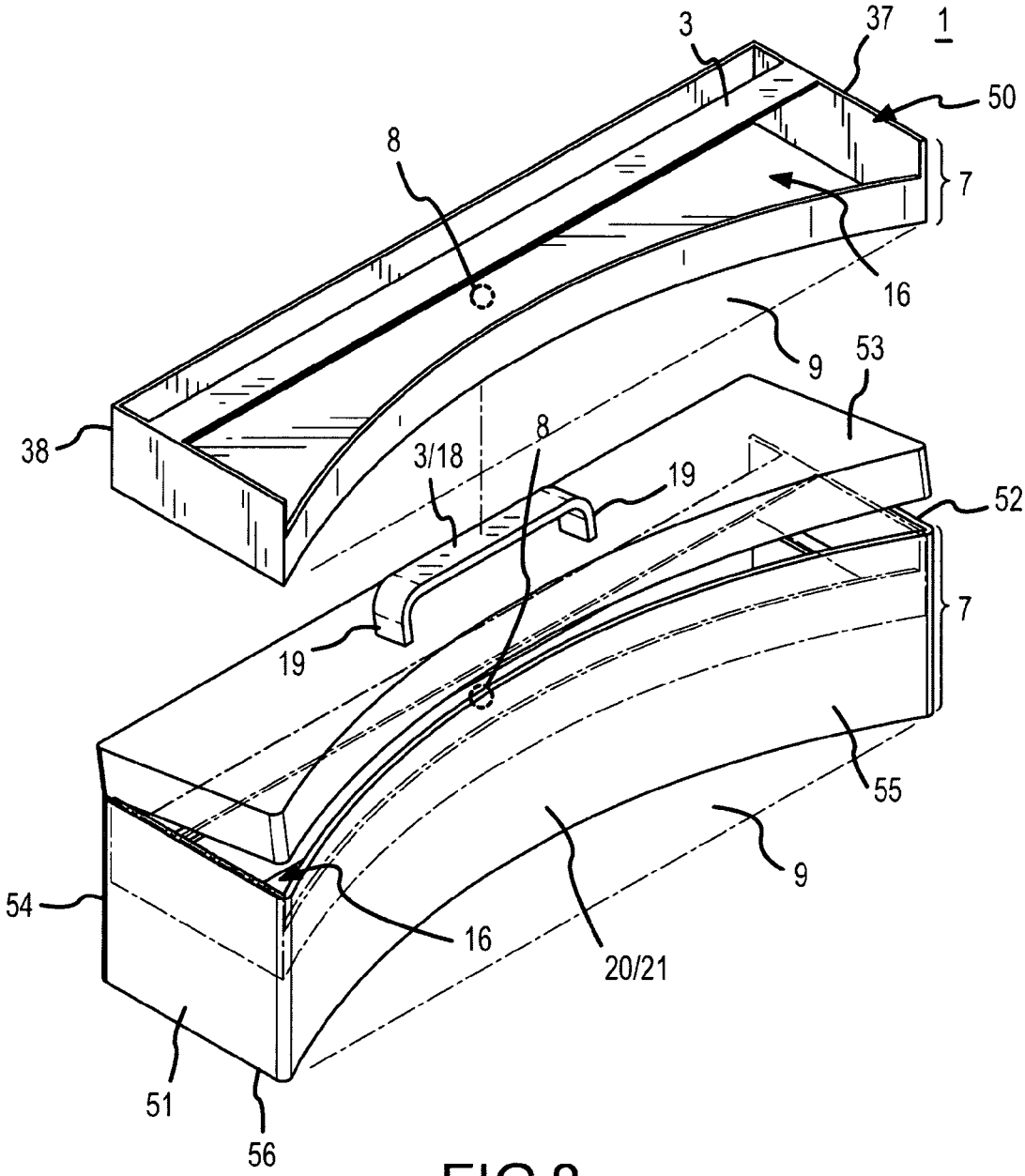

FIG. 8 provides a perspective view of particular close sided embodiments of the invention.

IV. DETAILED DESCRIPTION OF THE PREFERRED EMBODIMENTS

A tool caddy configured to locate a part of the body of a person proximate to the center of mass of the tool caddy.

Now referring primarily to FIGS. 1, 6, and 8, a particular method of utilizing an embodiment of the inventive tool caddy (1) is illustrated. A person (2) can engage the handle (3) of the tool caddy (1) with a hand (4) to elevate of the tool caddy (1) a distance (5) above a support surface (6). The carrier (7) portion of the tool caddy (1) can be configured to recess toward the handle (3) or toward the center of mass (8) of the tool caddy (1) to provide an open recess area (9). The open recess area (9) can be configured to receive a part of the body (10) of the person (2) upon locating the carrier (7) at the distance (5) above the support surface (6). By receiving the part of the body (10) of the person (2) into the open recess area (9), the part of the body (10) locates closer to the center of mass (8) of the tool caddy (1) or closer to the handle (3) of the tool caddy (1) (or both) than occurs when the part of the body (10) of the person (2) has a location outside of the open recess area (9).

In the example shown by FIG. 1, elevating the carrier (7) a distance (5) above the support surface (6) allows the person (2) to walk with a part of the body (10) (a part of the leg (11) as to this embodiment of the invention) located in the open recess area (9). Locating a part of the leg (11) in the open recess area (9) locates the leg (11) (as well as the center of mass of the body (12) of the person (2) closer to the center of mass (8) of the carrier (7)(as well as the center of mass (8) of the tool caddy (1)). This can also establish a more acute angle (13) as defined by the arm (14) responsive to the tool caddy (1) and the part of body (10) of the person (2) proximate to the tool caddy (1). With the part of the leg (11) in the open recess area (9) the person (2) can travel with the tool caddy (1) from a first location to a second location. The tool caddy (1) can then be lowered the distance (5) to a location on the support surface (6) and the hand (4) disengaged from the handle (3).

The term "person" broadly encompasses any human or humans regardless of gender, profession, or stature, and while one person is shown in FIG. 1 carrying the tool caddy (1), the invention is not so limited, and two persons or a plurality of persons could engage the tool caddy (1) depending upon the constructional form of embodiment of tool caddy (1).

The term "part of the body" broadly encompasses any part of the body of a person (2) and while the example above shows a part of the leg (11) received by the open recess space (9) of the inventive tool caddy (1) it is not so limited and any body part (10) such as the hip, waist, chest, or otherwise can be received by the recess element(s) (9) of various embodiments of the tool caddy (1).

The term "support surface" broadly encompasses any manner of surface capable of supporting the tool caddy (1), the person (2), or the person (2) engaged with the tool caddy (1), such as the earth, a pavement, a floor or roof of a building, the bed of a vehicle, or the like, and the term "a distance above the support surface" can be any amount of distance depending upon the configuration of the tool caddy (1), the recess element (9), the part of the body (10) received by the recess element (9), and the application in which the tool caddy ( ) is utilized.

The term "center of mass" with respect to the tool caddy (1) can be located by suspending the tool caddy (1) by the handle (3) and extending a plumb line and then suspending the tool caddy (1) from a second location and extending a plumb line. The intersection of the two plumb lines provides the center of mass (8) of a particular embodiment of the tool caddy (1).

The term "closer to the handle" means a lesser amount of distance between any object, such as a part of the body (10) (including but not limited to a part of the leg (11)) of a person (2), and the handle (3) of the tool caddy (1) which as to certain embodiments of the invention may not necessarily place the object closer to the center of mass (8) of the tool caddy (1).

Now referring primarily in FIGS. 1 and 7, particular embodiments of the inventive tool caddy (1) are configured to be utilized as above-described without enclosing a space in which tools (15)(collectively shown in dashed lines in FIG. 7) can be located or contained, as shown for example in FIG. 8 which shows a pair of embodiments of the inventive tool caddy (1) having a plurality of side panels and a bottom panel (further described below) which can be configured to establish an enclosed space (16) in which the tools (15) can be located. Rather, particular embodiments of the inventive tool caddy (1) shown in FIGS. 1-7 provide an open sided configuration which provides a carrier (7) portion on which the tools (15) can be secured allowing the person (2) to engage or remove and return the tools (15) to the tool caddy (1) without reaching into an enclosed space (16) containing the tools (15).

Now referring to FIGS. 1-8, examples of open sided embodiments of the inventive tool caddy (1) and closed sided embodiments of the inventive tool caddy (1) are shown. However, these examples are not intended to limit the constructional forms of the inventive tool caddy (1) and numerous and varied constructional forms can be produced which operate or can be utilized as above described. Generally, embodiments of the inventive tool caddy (1) include the carrier (7) portion to which or in which tools (15) can be placed, contained, secured, or the like, which can be made responsive to the travel of the handle (3). Now referring primarily to FIGS. 2 and 3, embodiments of the inventive tool caddy (1) can provide the handle (3) in the constructional form of an elongated member (17). Alternately, referring primarily to FIG. 8, embodiments of the inventive tool caddy (1) can provide a handle (3) in the constructional form of an inverted U (18) having each of the legs (19) coupled to the carrier (7) of the tool caddy (1) (whether directly or indirectly). However, any constructional form of a handle (3) can be utilized which allows a part of the body (10) of the person (2) to engage the tool caddy (1) in manner which allows the person to generate travel in the handle (3) and corresponding travel in the carrier (7) portion of the tool caddy (1).

As shown by FIGS. 1, 6 and 8 the carrier (7) portion of the tool caddy (1) can further include a recess element (20) by which a portion of the carrier (7) recesses toward the handle (3)(17)(18) (or toward the center of mass (8) of the tool caddy (1)) and which bounds the open recess area (9). As shown by FIG. 8, closed sided embodiments of the tool caddy (1) can include a side panel (21) having which can be configured to recess toward the handle (3)(18) to establish the recess element (20) and the corresponding open recess area (9) which it bounds. Alternately, as shown by FIG. 6, particular open sided embodiments of the tool caddy (1) can include for example a member (22) having a first bifurcated end (23) and a second bifurcated end (24) which establishes a first recess element (20)/(25) including the surface of the member (26) and the first leg (27) of the first bifurcated end (23) and the first leg (28) of the second bifurcated end (24) and further establishes a second recess element (29) including the surface of the opposed surface of the member (30) and the second leg (31) of the first bifurcated end (23) and the second leg (32) of the second bifurcated end (24) each of which bound a corresponding first open recess area (9)/(33) and a second open recess area (9)/(34).

Understandably, whether the tool caddy (1) has one recess element (20), a first recess element (25) and a second recess element (29) as shown by FIGS. 1 and 6, or a plurality of recess elements (20), the recess element (20) can be provided in numerous and varied configurations which bound a correspondingly varied and numerous configurations of the open recess area (9). As to certain embodiments of the inventive tool caddy (1) the recess element (20) can be configured to avoid or reduce contact with a part of the body (10) of a person (2) as the tool caddy (1) is a carried by engaging the handle (3). As to other embodiments of the inventive tool caddy (1), the recess element (20) can be configured to receive a part of the body (10) of a person (2) upon elevating the tool caddy (1) a distance (5) from the support surface (6). Again, as to other embodiments of the inventive tool caddy (1), the recess element(s)(20) can be configured to locate the center of mass (8) of the tool caddy (1) closer to the center of mass of the person (12) engaged to the tool caddy (1) or to locate the part of the body (10) of the person (2) received in the open recess area (9) closer to the center of mass (8) of the tool caddy (1) or closer to the handle (3) of the tool caddy (1), or all of the above in various permutations an combinations depending upon the application.

Now referring primarily to FIGS. 2-7, a particular embodiment of the inventive tool caddy (1) can include a handle (3) which comprises an elongated member (17) having a first elongated member end (35) and a second elongated member end (36) each coupled to a corresponding first carrier support member (37) and a second carrier support member (38). As shown in FIGS. 4 and 5, the first carrier support member (37) and the second carrier support member (38) can each comprise a pair of carrier support members (39) coupled proximate to the opposed ends of a cross member (40) which can be a linear cross member or an arcuate cross member as shown in the Figures or other configuration which establishes the pair of carrier support members (39) a distance apart (41) (such distance can vary from one embodiment of the invention to another depending upon the application). As to the particular embodiment of the inventive tool caddy (1) shown in FIGS. 4 and 5, the pair of carrier support members (39) and the arcuate cross member (40) can be produced as a single integral piece by generating the U-shaped configuration in a hollow cylindrical metal conduit or forming the part in a mold, as but two examples. As to certain embodiments of the inventive tool caddy (1), each of the pair of carrier support members (39) can further include a wheel (41) which rotates on an axis (42) and the wheel of sufficiently circular form to facilitate travel of the tool caddy (1) on the support surface (6).

Again referring primarily to FIGS. 2-7, embodiments of the inventive tool caddy which are open sided can provide a carrier (7) portion having a plurality of tool securement elements (43) to which tools (15) releasably secure. As to the particular embodiment of the inventive tool caddy (1) shown in FIGS. 2-7, the carrier (7) can comprise a member (22)(or first member) having a first bifurcated end (23) and a second bifurcated end (24) and can further include a second member (43) having a first bifurcated end (44) and a second bifurcated end (45). The first bifurcated end (23)(44) and the second bifurcated end (24)(45) of the first member (22) and the second member (56) can be configured such that the first leg (27)(46)(28)(47) and the second leg (31)(48)(32)(49) of each bifurcated end (23)(44)(24)(45) correspondingly connect to a first carrier support member (37) and a second carrier support member (38). The tool securement elements (43) can be coupled to the carrier (7) spaced a sufficient distance apart to allow releasable securement of the corresponding tools (15). However, this does not limit the tool securement elements (43) to being coupled solely to the carrier (7) and the tool securement elements (43) can be coupled to parts of the handle (3) and carrier support members (39). The tool securement elements (43) can be configured to secure a wide variety of tools (15) without limitation hammers, wrenches, drivers, socket handles and sockets, allen wrenches, pliers, pipe cutters, awls, punches, tape, containers, or the like.

Now referring primarily to FIG. 8, another embodiment of the carrier (7) having the recess element (20) which establishes the open recess area (9) as above-described can also take the form of a tray (50) which can be made responsive to the pair of carrier support members (37)(38) and a handle (3). A method of using this particular embodiment of the invention similar to that described for the embodiment of the inventive tool caddy shown in FIG. 1.

Again referring primarily to FIG. 8, embodiments of the inventive tool caddy can be close sided. As to these embodiments of the invention, the handle (3) can be made responsive to a first end panel (51) and a second end panel (52)(whether as an elongated member as above-described or through a top panel (53)) which can be joined to a first side panel (54) and a second side panel (55). A bottom panel (56) can join the side panels to establish a partially or entirely enclosed space (16) in which tools (15) can be contained. The first side panel (54) or the second side panel (55) or both side panels (54)(55) can recess toward the handle (3) or toward the center of mass of the carrier (8) to establish the open recess area(s)(9) which can be configured to receive a part of the body (10) of a person (2), as above-described.

As can be easily understood from the foregoing, the basic concepts of the present invention may be embodied in a variety of ways. The invention involves numerous and varied embodiments of an inventive liquid sampler and methods of producing and using such inventive liquid sampler.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "recess" should be understood to encompass disclosure of the act of "recessing" —whether explicitly discussed or not—and, conversely, were there effectively disclosure of the act of "recessing", such a disclosure should be understood to encompass disclosure of a "recess" and even a "means for recessing." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the liquid samplers herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A tool caddy, comprising:

a. a handle which comprises an elongated member having a length disposed between a first elongated member end and a second elongated member end;

b. a first carrier support and a second carrier support, each of which provide a pair of carrier support members having a first end coupled to the opposed ends of a cross member, and wherein said first end and said second end of said elongated member correspondingly couple in substantially perpendicular relation to a corresponding one said cross member;

c. an open sided carrier including a first central member having a length disposed between a first bifurcated end and a second bifurcated end, each of said first bifurcated end and said second bifurcated end including a pair of legs each of which extend outwardly from said central member to correspondingly connect to said pair of carrier support members wherein whereby said central member has a location a distance below said elongated member and between each pair of carrier support members to provide an open recess area on each side of said open sided carrier.

2. A tool caddy as described in claim 1, wherein said open sided carrier further comprises a second central member having a length disposed between a first bifurcated end and a second bifurcated end, each of said first bifurcated end and said second bifurcated end coupled to said second central member including a pair of legs each of which extend outwardly from said second central member to correspondingly connect to said pair of carrier support members, whereby said second central member has a location a distance below said first central member and between each pair of carrier support members to provide said open recess area on each side of said open sided carrier.

3. A tool caddy as described in claim 2, further comprising at least one tool securement element coupled to said open sided carrier.

4. A tool caddy as described in claim 3, further comprising a wheel coupled to a second end of each one of said pair of carrier support members.

5. A tool caddy as described in claim 4, wherein said open recess area defined by the configuration of said open sided carrier provides a recess element having a configuration capable of receiving a portion of the body of a person upon gripped engagement of said handle by the hand of the person.

6. A method of producing a tool caddy, comprising the steps of:

a. providing a handle which comprises an elongated member having a length disposed between a first elongated member end and a second elongated member end;

b. connecting a first carrier support and a second carrier support to a corresponding one of said first elongated member end and said second elongated member end, wherein each of said first carrier support and said second carrier support provides a pair of carrier support members having a first end coupled to the opposed ends of a cross member, and wherein said first end and said second end of said elongated member correspondingly couple in substantially perpendicular relation to a corresponding one said cross member;

c. providing an open sided carrier responsive to said handle, wherein said open sided carrier includes a first central member having a length disposed between a first bifurcated end and a second bifurcated end, each of said first bifurcated end and said second bifurcated end including a pair of legs each of which extend outwardly from said central member to correspondingly connect to said pair of carrier support members whereby said central member has a location a distance below said elongated member and between each pair of carrier support members to provide an open recess area on each side of said open sided carrier.

7. A method of producing a tool caddy as describe in claim 6, wherein said step of providing an open sided carrier further comprises the step of providing a second central member having a length disposed between a first bifurcated end and a second bifurcated end, each of said first bifurcated end and said second bifurcated end coupled to said second central member including a pair of legs each of which extend outwardly from said second central member to correspondingly connect to said pair of carrier support members, whereby said second central member has a location a distance below said first central member and between each pair of carrier support members to provide said open recess area on each side of said open sided carrier.

8. A method of producing a tool caddy as describe in claim 7, further comprising the step of coupling at least one tool securement element to said open sided carrier.

* * * * *